US009242497B2

(12) United States Patent
Watanabe et al.

(10) Patent No.: US 9,242,497 B2
(45) Date of Patent: Jan. 26, 2016

(54) INKJET RECORDING MEDIUM

(71) Applicant: Nippon Paper Industries Co., Ltd., Tokyo (JP)

(72) Inventors: Misaki Watanabe, Tokyo (JP); Akinobu Chatani, Tokyo (JP); Satoshi Tsuda, Tokyo (JP); Tadashi Yoshida, Tokyo (JP); Takanori Otsuhata, Tokyo (JP); Koji Kutsuwa, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 14/418,350

(22) PCT Filed: Jul. 29, 2013

(86) PCT No.: PCT/JP2013/070483

§ 371 (c)(1),
(2) Date: Jan. 29, 2015

(87) PCT Pub. No.: WO2014/021263

PCT Pub. Date: Feb. 6, 2014

(65) Prior Publication Data

US 2015/0298479 A1 Oct. 22, 2015

(30) Foreign Application Priority Data

Jul. 31, 2012 (JP) ..... 2012-169580
Mar. 29, 2013 (JP) ..... 2013-073357

(51) Int. Cl.
*B41M 5/00* (2006.01)
*B41M 5/52* (2006.01)

(52) U.S. Cl.
CPC ..... *B41M 5/5218* (2013.01); *B41M 5/52* (2013.01); *B41M 5/5245* (2013.01); *B41M 5/5254* (2013.01)

(58) Field of Classification Search
CPC ..... B41M 5/5218; B41M 5/5245; B41M 5/5254; B41M 5/52
See application file for complete search history.

(56) References Cited

U.S. PATENT DOCUMENTS

2007/0098928 A1* 5/2007 Sen ..... B41M 5/5218 428/32.34

FOREIGN PATENT DOCUMENTS

| | | |
|---|---|---|
| JP | S60-067190 | 4/1985 |
| JP | H06-320857 | 11/1994 |
| JP | H07-17126 | 1/1995 |
| JP | H07-17127 | 1/1995 |
| JP | H07-25131 | 1/1995 |
| JP | H07-40648 | 2/1995 |
| JP | H10-147057 | 6/1998 |
| JP | H10-152544 | 6/1998 |
| JP | 2001-246831 | 9/2001 |
| JP | 2006-181509 | 7/2006 |
| JP | 2009-056615 | 3/2009 |
| WO | WO 2014/021263 | 2/2014 |

OTHER PUBLICATIONS

International Search Report corfresponding to PCT/JP2013/070483 mailed Oct. 15, 2013.
Japanese Industrial Standard p. 8122-1976. "Testing Method for Stöckigt Sizing Degree of Paper," Japanese Standards Association (1976).
Japanese Testing Standard J. TAPPI No. 32-2:2000. "Paper-Water Absorption Test Method. Part 2: Water Drop Method." Japan Technical Association of the Pulp and Paper Industry (2000).
Written Opinion of the International Searching Authority corresponding to International Patent Application No. CT/JP2013/070483 mailed Oct. 15, 2013.
Notification of Transmittal of Translation of the International Preliminary Report on Patentability (Chapter I or Chapter II of the Patent Cooperation Treaty) corresponding to International Patent Application No. PCT/JP2013/070483 dated Feb. 12, 2015.
Notice of Acceptance corresponding to Australian Patent Application No. 2013297583 dated Feb. 20, 2015.

* cited by examiner

*Primary Examiner* — Betelhem Shewareged
(74) *Attorney, Agent, or Firm* — Jenkins, Wilson, Taylor & Hunt, P.A.

(57) ABSTRACT

An inkjet recording medium, comprising an ink-receiving layer containing a pigment, a binder and an inkjet ink-fixing agent comprising a cationic compound disposed on at least one surface of a base paper, wherein 50% or more by weight of calcium carbonate is contained in terms of a solid content based on a total amount of the pigment contained in the ink-receiving layer; 75 to 90 parts by weight of the pigment, 1 to 10 parts by weight of the binder and 5 to 20 parts by weight of the inkjet ink-fixing agent are contained based on 100 parts by weight of the ink-receiving layer; the drop water absorbency of the ink-receiving layer (according to the drop water absorbency defined in Japan Technical Association of the Pulp and Paper Industry, J. TAPPI, No. 32-2:2000 except that a drop water amount is 0.001 ml) is 200 seconds or less; and a Stockigt sizing degree according to JIS-P-8122 for the inkjet recording medium is 5 seconds or less.

21 Claims, No Drawings

INKJET RECORDING MEDIUM

FIELD OF THE INVENTION

The present invention relates to an inkjet recording medium including an ink-receiving layer disposed on a base paper. More particularly, the present invention relates to an inkjet recording medium including an ink-receiving layer containing a pigment, which provides an excellent ink-drying property and an excellent water resistance during inkjet printing, a highly fine image quality and a high color development, a texture of offset printing and a writing suitability.

DESCRIPTION OF THE RELATED ART

An inkjet recording method has been used in many applications along with a rapid improvement in printing performance as it is easy to perform a full color printing and a printing noise is suppressed. Examples of the applications include a document recording by a word-processing software, a digital image, e.g., a digital photograph, recording, a copy of a beautiful print material such as a silver salt photograph and a book captured using a scanner, and an image creation for display such as a relatively small number of posters.

For these applications, the inkjet recording medium having the configuration suitable for each have been proposed. For example, when characters are mainly recorded, a plain paper type medium where a recording is made directly on a base paper is used. When a finer image quality and a higher color development are desirable, a coated paper type medium where an ink-receiving layer is coated on a substrate is used. In particular, when a high glossiness comparable to silver salt photographs is required, a cast paper type medium where an outermost layer of a coating layer such as an ink-receiving layer is formed by a cast coating method is used.

One of the fields to which the inkjet recording method is applied is a printing field. In the related art, an offset printing method has been mainly used, which needs a plate making. On the other hand, the inkjet recording method does not need the plate making, which enables a small lot printing in an easy and inexpensive manner and is environmentally friendly. Further, there are advantages that a continuous printing of variable information being different for each part is possible and that color can be easily adjusted such that no special skill to operate a printer is needed.

Here, considering alternating the offset printing method with the inkjet recording method, a printed matter by the inkjet printing method should have a texture and a writing suitability equivalent to that by the offset printing method in the related art. In addition, in the offset printing method, ink easily stays on a surface of a medium. In contrast, in the inkjet recording method, ink easily penetrates into the medium, which results in a tendency that a color development tends to be inferior as compared to the offset printing method.

In order to improve the color development of the inkjet recording system, it is known that the coated paper type inkjet recording medium is used as described above. In the coated paper type inkjet recording medium, an ink-receiving layer mainly containing a bulky pigment having many voids such as silica and aluminum oxide (alumina) and a binder such as polyvinyl alcohol and starch is generally coated on a substrate, thereby providing an excellent ink absorption property, a highly fine image quality and a high color development. However, there are problems that the coated paper type inkjet recording medium has a texture different from that of the offset printing recording medium for coating a pigment such as kaolin and clay generally, has a poor writing suitability and easily induces a phenomenon that the ink-receiving layer falls off from the substrate (dusting).

In order to improve these problems in the coated paper type inkjet recording medium, there are disclosed an inkjet recording medium where an ink-receiving layer is formed on a substrate at a coating amount of about 0.1 to 10 g/m$^2$ per one surface in terms of a solid content such as an inkjet recording sheet having an ink-receiving layer containing a non-spherical cationic colloidal silica disposed on a substrate using a specific filler and a sizing agent (Patent Literatures 1 to 3) and an inkjet printing sheet where a surface of a specific substrate is covered with a particulate inorganic pigment having a composition mainly containing aluminum oxide (alumina) (Patent Literature 4).

[Patent Literature 1] Japanese Unexamined Patent Publication No. Hei 07-017126

[Patent Literature 2] Japanese Unexamined Patent Publication No. Hei 07-017127

[Patent Literature 3] Japanese Unexamined Patent Publication No. Hei 07-025131

[Patent Literature 4] Japanese Unexamined Patent Publication No. 2001-246831

SUMMARY OF INVENTION

Problems to be Solved by the Invention

However, in the inkjet recording media described in Patent Literatures 1 to 3 or Patent Literature 4, as a very expensive pigment such as colloidal silica and aluminum oxide (alumina) is used as a pigment for the ink-receiving layer, a resultant inkjet recording medium is expensive and an ink-drying property during the inkjet printing is poor. In addition, the inkjet recording medium has a texture different from that of the offset printing recording medium.

On the other hand, when the pigment in the ink-receiving layer is dispersed to provide a slurry, calcium carbonate is dispersed easier than silica and aluminum oxide (alumina) and the slurry has a low viscosity, thereby increasing the concentration of the slurry. Accordingly, the concentration of the coating color of the ink-receiving layer can be increased, a burden for drying the coating color is small and the inkjet recording medium can be produced at high speed. Furthermore, when the concentration of the coating color in the ink-receiving layer is increased, a phenomenon that the binder in the coating color of the ink-receiving layer is penetrated into the substrate (migration) is less likely to occur, uneven coating of the ink-receiving layer is less likely to occur, a highly fine image is provided and the ink-receiving layer has an excellent surface strength.

In the general inkjet recording medium, however, a cationic compound is included in the medium for imparting water resistance to the printing image and is fixed by forming an ion complex by ionic bonds with an anionic coloring agent in the inkjet ink. Here, if calcium carbonate is used as the pigment in the ink-receiving layer, a problem arises that stability of the coating color is poor upon the preparation of the coating color in the ink-receiving layer. In other words, calcium carbonate is generally dispersed using an anionic dispersant and is used as a slurry. A cationic compound having a fixing property to the coloring agent in the inkjet ink is hereinafter referred to as an "inkjet ink fixing agent". Once the inkjet ink fixing agent is mixed with a calcium carbonate slurry for the preparation of the coating color in the ink-receiving layer, the cationic inkjet ink fixing agent is reacted with the anionic dispersant to lose its effect and calcium carbonate is aggregated and precipitated to decrease the stability of the coating color.

Furthermore, as the calcium carbonate has the ink absorption property lower than those of silica and alumina, the color development (print density) and fineness (bleeding) are undesirably poor. If a large amount of calcium carbonate is coated (thick) on the base paper, the ink absorption property is not improved. In particular, when the basis weight of the inkjet recording medium (i.e., the thickness of the base paper) is low, the recording medium may be wavy (uneven), so-called "cockling" is likely to occur after printing. The "cockling" occurs remarkably especially when both sides of the inkjet recording medium are printed.

Accordingly, the present invention provides an inkjet recording medium mainly containing (50 wt % or more) inexpensive calcium carbonate as a pigment, having an excellent ink-drying property and an excellent water resistance during an inkjet printing, a highly fine image quality and a high color development, a texture of offset printing and a writing suitability.

Solution to Problem

Through intense studies by the present inventors, it has been succeeded that a printing property is improved by adjusting the percentage of a binder, an inkjet ink fixing agent and calcium carbonate in the ink-receiving layer and reducing the Stockigt sizing degree of the inkjet recording medium (i.e., base paper) to increase the absorption property, even when calcium carbonate having a poor ink absorbency is used as the main component of the pigment.

The present invention provides an inkjet recording medium, comprising an ink-receiving layer containing a pigment, a binder and an inkjet ink-fixing agent comprising a cationic compound disposed on at least one surface of a base paper, wherein 50% or more by weight of calcium carbonate is contained in terms of a solid content based on a total amount of the pigment contained in the ink-receiving layer; 75 to 90 parts by weight of the pigment, 1 to 10 parts by weight of the binder and 5 to 20 parts by weight of the inkjet ink-fixing agent are contained based on 100 parts by weight of the ink-receiving layer; the drop water absorbency of the ink-receiving layer (according to the drop water absorbency defined in Japan Technical Association of the Pulp and Paper Industry, J. TAPPI, No. 32-2:2000 except that a drop water amount is 0.001 ml) is 200 seconds or less; and a Stockigt sizing degree according to JIS-P-8122 for the inkjet recording medium is 5 seconds or less.

Preferably, a contact angle of the ink-receiving layer is 40 degrees or more after 0.06 seconds from dropping 0.004 ml of distilled water.

Or, preferably, a contact angle of the ink-receiving layer is less than 40 degrees after 0.06 seconds from dropping 0.004 ml of distilled water.

Preferably, the drop water absorbency of the ink-receiving layer is not greater than the drop water absorbency of a split plane (the drop water absorbency according to the drop water absorbency defined in Japan Technical Association of the Pulp and Paper Industry, J. TAPPI, No. 32-2:2000 except that a drop water amount is 0.001 ml) where the base paper is exposed when the inkjet recording medium is peeled off from the surface of the ink-receiving layer in the direction of the thickness.

Preferably, a basis weight of the inkjet recording medium is 30.0 g/m$^2$ to 70.0 g/m$^2$.

Preferably, a volume 50% average particle diameter (D50) as measured by laser light scattering method of the calcium carbonate contained in the ink-receiving layer is 0.3 to 10.0 μm.

Preferably, a coating amount of the ink-receiving layer in terms of solid content of one surface is 1.0 g/m$^2$ to 15.0 g/m$^2$.

According to the present invention, there is provided an inkjet recording medium mainly containing inexpensive calcium carbonate as a pigment, having an excellent ink-drying property and a water resistance during an inkjet printing, a highly fine image quality and a high color development, a texture of offset printing and a writing suitability.

DESCRIPTION OF THE EMBODIMENTS

An inkjet recording medium, comprising an ink-receiving layer containing a pigment, a binder and an inkjet ink-fixing agent comprising a cationic compound disposed on at least one surface of a base paper, wherein 50% or more by weight of calcium carbonate is contained in terms of a solid content based on a total amount of the pigment contained in the ink-receiving layer; 75 to 90 parts by weight of the pigment, 1 to 10 parts by weight of the binder and 5 to 20 parts by weight of the inkjet ink-fixing agent are contained based on 100 parts by weight of the ink-receiving layer; the drop water absorbency of the ink-receiving layer (according to the drop water absorbency defined in Japan Technical Association of the Pulp and Paper Industry, J. TAPPI, No. 32-2:2000 except that a drop water amount is 0.001 ml) is 200 seconds or less; and a Stockigt sizing degree according to JIS-P-8122 for the inkjet recording medium is 5 seconds or less.

(Pigment)

The ink-receiving layer of the present invention contains a pigment. Examples include known pigments such as calcium carbonate, silica, kaolin, calcined kaolin, clay, calcium silicate, calcium sulfate, aluminum oxide (alumina), aluminum hydroxide, aluminum silicate, titanium oxide, zinc oxide, magnesium carbonate, magnesium silicate, talc, zeolite and plastic pigments. In addition, a combination thereof may be possible depending on the required quality.

Calcium carbonate is 50% or more by weight in terms of a solid content based on a total amount of the pigment contained in the ink-receiving layer because a pigment slurry and a coating color of the ink-receiving layer can have high concentrations and a load upon drying of the coating color is small such that the inkjet recording medium can be produced at high speed; a phenomenon that the binder in the coating color of the ink-receiving layer is penetrated into the substrate (migration) less occurs, uneven coating of the ink-receiving layer is less likely to occur and a highly fine image is provided; the ink-receiving layer has an excellent surface strength; and the inkjet recording medium has a high color development, a texture of offset printing and a writing suitability. Calcium carbonate is preferably 80% or more by weight, more preferably 90% or more by weight in terms of a solid content based on a total amount of the pigment contained in the ink-receiving layer.

If the ink-receiving layer is too smooth and slippery, pencil writing is difficult. Instead, if a bulky pigment such as silica and alumina is used, fine unevenness is produced on the surface of the ink-receiving layer, a pencil is likely to be caught, and the surface layer of the ink-receiving layer is scratched, resulting in a poor writing suitability. In contrast, if a large amount (50% or more by weight in terms of a solid content) of calcium carbonate is contained in the ink-receiving layer, the unevenness of the ink-receiving layer becomes not too much, and the pencil is not too slippery and caught, resulting in a good writing suitability.

(Calcium Carbonate)

Calcium carbonate of the present invention may be any of precipitated calcium carbonate and ground calcium carbonate. In addition, the crystalline form may be any of a calcite crystalline form, an aragonite crystal form and a vaterite crystal form. Furthermore, any particulate form may be used. Non-limiting examples of the particulate form include cubic, spindle, columnar, needle-like, spherical, indefinite bulk, three-dimensionally entanglement of these form. The indefinite bulk is preferable in that high viscosity of the coating color for the ink-receiving layer is suppressed and a high solid content is easily provided.

A particle size of calcium carbonate used in the present invention is not particularly limited and has usually volume 50% average particle diameter (D50) measured by a laser light scattering method of 0.01 to 20 μm. In particular, D50 is preferably 0.3 to 10.0 μm in that a pigment slurry and the coating color of the ink-receiving layer can easily have high concentrations, coating unevenness of the ink-receiving layer is small and the coating suitability is excellent. The measurement of D50 by the laser light scattering method can be performed by using MASTER SIZER S manufactured by MALVERN Instruments Ltd.

(Binder)

The ink-receiving layer of the present invention contains a binder. Non-limiting examples of the binder contained in the ink-receiving layer include any known binders used in typical coating paper such as polyvinyl alcohols including fully saponified polyvinyl alcohol, partly saponified polyvinyl alcohol, acetoacetylated polyvinyl alcohol, carboxyl-modified polyvinyl alcohol, amide-modified polyvinyl alcohol, sulfonate-modified polyvinyl alcohol, butyral-modified polyvinyl alcohol, olefin-modified polyvinyl alcohol, nitrile-modified polyvinyl alcohol, pyrolidone-modified polyvinyl alcohol, silicone-modified polyvinyl alcohol, silanol-modified polyvinyl alcohol, cation-modified polyvinyl alcohol and terminal alkyl-modified polyvinyl alcohol; cellulose ethers including hydroxyethyl cellulose, methyl cellulose, ethyl cellulose, carboxy mehtyl cellulose, acetyl cellulose and a derivative thereof; starches including starch, enzyme-modified starch, thermochemically-modified starch, oxidized starch, esterified starch, etherified starch (for example, hydroxyehtylated starch) and cationized starch; polyacrylamides including polyacrylamide, cationized polyacrylamide, anionized polyacrylamide and amphoteric polyacrylamide; urethane based resins including polyester polyurethane based resin, polyether polyurethane based resin and polyurethane based ionomer resin; styrene-butadiene based resin including styrene-butadiene copolymer, styrene-butadiene-acrylonitrile copolymer, styrene-butadiene-acryl copolymer; butadiene-acrylonitrile copolymer; unsaturated polyester resin; polyvinyl acetate; vinyl chloride-vinyl acetate copolymer; polyvinyl chloride; polyvinylidene chloride; polyacrylic ester; casein; gelatin; gum Arabic; polyvinyl butyral; polystyrol and a copolymer thereof; silicone resin; petroleum resin; terepene resin; ketone resin; and coumarone resin. These may be used in combination.

According to the present invention, polyvinyl alcohols, starches and polyacrylamides are preferably used as the binder because the binder acts as a protective colloid for protecting a pigment such as calcium carbonate and stability of the coating color of the ink-receiving layer is improved. In particular, in view of a balance between surface strength of the ink-receiving layer and ink absorption property, polyvinyl alcohols are preferably used as the binder. When polyvinyl alcohol is used, the type thereof is determined by the performance to be required and is not particularly limited. One type of polyvinyl alcohol may be used alone, two or more polyvinyl alcohols may be used in combination, or polyvinyl alcohols and other binder may be used in combination. Preferably, two or more polyvinyl alcohols may be used in combination, or polyvinyl alcohols and other binder may be used in combination.

The amount of the binder in the ink-receiving layer of the present invention is 1 to 10 parts by weight, preferably 2 to 8 parts by weight, more preferably 5 to 8 parts by weight in terms of a solid content based on 100 parts by weight of the ink-receiving layer. By setting the amount of the binder to the above range, the balance between the surface strength of the ink-receiving layer and ink absorption property is improved.

(Inkjet Ink Fixing Agent)

The ink-receiving layer of the present invention contains an inkjet ink fixing agent. The inkjet ink fixing agent used in the ink-receiving layer of the present invention is not particularly limited and may be the inkjet ink fixing agent comprising a known cationic compound for use in a typical inkjet recording medium. Preferably, a cationic water soluble polymer such as polyethyleneimine quaternary ammonium salt derivative, polyamine polyamide epihalohydrin condensation polymer, polycondensation product formed by the reaction of ammonia, amines such as monoamine and polyamine, and epihalohydrins (dialkyl amine-ammonia-epichlorohydrin condensation polymer), dicyandiamide-formaldehyde resin, diehtylenetriamine-dicyandiamide-ammonium chloride polymer and dimethyl diallyl ammonium chloride polymer. In the present invention, because the water resistance is excellent during the inkjet printing, the condensation polymer formed by the reaction of ammonia, amines and epihalohydrins are particularly preferred.

Examples of the amines include primary amines, secondary amines, tertiary amines, polyalkylene polyamines, alkanolamines, and mono-amines. Examples of the secondary amines includes dimethylamine, diethylamine, dipropylamine, methyl ethylamine, methyl propylamine, methyl butylamine, methyl octylamine, methyl laurylamine and dibenzylamine. Examples of the tertiary amines include trimethylamine, triethylamine, tripropylamine, triisopropylamine, tri-n-butylamine, tri-sec-butylamine, tri-tert-butylamine, tripentylamine, trihexylamine, trioctylamine and tribenzyl amine. These may be used alone or in combination. In the present invention, dimethylamine and diethylamine, as the secondary amine, are preferable.

Examples of the epihalohydrins include epichlorohydrin, epibromohydrin, epiiodohydrin and methyl epichlorohydrin. These may be used alone or in combination. In the present invention, epichlorohydrin is particularly preferable.

As a synthetic method of the condensation polymer formed by reacting ammonia, amines and epihalohydrins, for example, the known method described in Japanese Unexamined Patent Publication No. Hei 10-152544 and Japanese Unexamined Patent Publication No. Hei 10-147057.

The amount of the inkjet ink fixing agent in the ink-receiving layer of the present invention is 5 to 20 parts by weight, preferably 8 to 15 parts by weight, more preferably 10 to 13 weight parts in terms of a solid content based on 100 parts by weight of the ink-receiving layer. By setting the amount of the inkjet ink fixing agent to the above range, the image quality and the water resistance during the inkjet printing are improved.

(Other Components)

To the ink-receiving layer of the present invention, an auxiliary agent such as a pigment dispersant, a thickener, a water retention agent, a lubricant, a defoamer, a foam inhibitor, a mold release agent, a sizing agent, a foaming agent, a coloring dye, a coloring pigment, a fluorescent dye, a preservative, a water resistant agent, a surfactant, a pH adjusting agent, an antistatic agent, an ultraviolet absorber, an antioxidant and the like can be added, as appropriate.

In the present invention, 75 to 90 parts by weight (the total of other pigments and calcium carbonate) of the pigment described above, 1 to 10 parts by weight of the binder and 5 to 20 parts by weight of the inkjet ink-fixing agent are contained based on 100 parts by weight of the ink-receiving layer.

As described above, calcium carbonate has poor ink absorption. Accordingly, when the proportion of the binder in the ink-receiving layer is too large, the absorption of the ink-receiving layer decreases. On the other hand, when the proportion of the binder is too small, it is impossible to hold the pigment on the substrate and a uniform ink-receiving layer cannot be formed, thereby producing an inkjet recording medium with difficulty. Further, the binder acts as a protective colloid for protecting calcium carbonate. The effect is not sufficiently exerted when the proportion of the binder is too low. Therefore, during the preparation of the ink-receiving layer coating color, an anionic dispersing agent for calcium carbonate and a cationic inkjet ink fixing agent are reacted and aggregated, stability of the ink-receiving layer coating color decreases (paint viscosity increases), whereby forming a homogeneous ink-receiving layer is difficult.

When the proportion of the inkjet ink fixing agent is too large, calcium carbonate has poor ink absorption and the absorption of the ink-receiving layer decreases. Furthermore, the inkjet ink fixing agent has and shows high hydrophilicity, and has compatibility with the binder that functions as a protective colloid described above. Thus, the inkjet ink fixing agent is dissolved into the binder acting as the protective colloid and reduces the effect of the protective colloid. As a result, the stability of the ink-receiving layer coating color decreases (paint viscosity increases) by the similar reason as described above, whereby forming a homogeneous ink-receiving layer is difficult. On the other hand, when the proportion of the inkjet ink fixing agent is too small, water resistance of inkjet printed image is poor.

In view of the above, a mixing proportion of the pigment, the binder and the inkjet ink fixing agent within the ink-receiving layer is important. In particular, when polyvinyl alcohols, starches, or polyacrylamides having a high hydrophilicity are used as the binder, problems described above are likely to occur as the inkjet ink fixing agent is easily dissolved into the binder, the present invention is more effective. Note that the polyvinyl alcohols are most hydrophilic and are most effective in terms of protecting colloid.

(Base Paper)

As the base paper of the present invention, any known paper can be used as long as it is a sheet form. In view of a price and availability, the paper mainly composed of wood pulp is preferably used. Examples of the wood pulp include chemical pulp (unbleached or bleached softwood kraft pulp, unbleached or bleached hardwood kraft pulp etc.), =mechanical pulp (ground pulp, thermomechanical pulp, chemithermomechanical pulp, etc.), and de-inked pulp. They can be used alone or by mixing at any proportion.

It is preferable that the base paper includes a filler for improving opacity and smoothness of the base paper. Examples of the filler include any known fillers such as hydrated silica, white carbon, talc, kaolin, clay, calcium carbonate, titanium oxide, synthetic resin filler and the like. In addition, these can be used in combination depending on the required quality.

In the present invention, when the base paper includes calcium carbonate as the filler, the texture of the offset printing type is advantageously provided.

A pH for base paper making may be any of acidic, neutral and alkaline. A basis weight of the base paper is not particularly limited. Further, the base paper may contain an auxiliary agent such as aluminum sulfate, a sizing agent, a paper strengthening agent, a retention aid, a colorant, a dye, a defoamer, a pH adjusting agent as appropriate, as long as the advantages of the present invention are provided.

The base paper may be impregnated or coated with a sizing solution containing starch, polyvinyl alcohol, and a sizing agent in order to strengthen the paper and impart sizing properties. Further, the sizing solution may contain an auxiliary agent such as a fluorescent dye, a conductive agent, a water retention agent, a water resistant agent, a pH adjusting agent, a defoamer, a lubricant, a preservative and a surfactant as appropriate, as long as the advantages of the present invention are provided. Although a method of impregnating or coating is not especially limited, examples include an impregnating method represented by a pond size press and a coating method represented by a rod metering size press, a gate roll coater and a blade coater.

(Drop Water Absorbency)

In the inkjet recording medium of the present invention, a drop water absorbency of the ink-receiving layer is 200 seconds or less.

The drop water absorbency is measured according to Japan Technical Association of the Pulp and Paper Industry J. TAPPI No. 32-2:2000 (paper-water absorbance test method, part 2: dropping method) except that a drop water amount is 1 μl (0.001 ml). In other words, a test piece (paper) for a measurement is positioned horizontally, 1 μl (0.001 ml) of distilled water is dropped onto a measurement surface (i.e., a surface where a thermosensitive recording layer is disposed). The time until the dropped water is measured by visual inspection. The test piece (paper) for a measurement may have any size as long as the measurement is made, and may have a circle shape having a diameter of at least about 40 mm, for example.

The drop water absorbency is represented by the time (seconds). The higher the drop water absorbency is, the lower the water absorption property is. The lower the drop water absorbency is, the higher the water absorption property is.

In the present invention, the ink-drying property during the inkjet printing can be improved when the drop water absorbency of the ink-receiving layer is 200 seconds or less. If the water absorbency of the ink-receiving layer exceeds 200 seconds, the ink-drying property is poor, undried ink is undesirably transferred from the inkjet recording medium after printing to the other inkjet recording medium to make blot, bleeding is generated on a periphery of the image, specifically, scuffing (feathering) at rims of characters and bleeding generated by mixing colors at a boundary between different colors are significant.

Furthermore, in the present invention, the drop water absorbency of the above-described ink-receiving layer is preferably not greater than the drop water absorbency of a split plane where the base paper is exposed when the inkjet recording medium is peeled off in the direction of the thickness. The drop water absorbency of the ink-receiving layer is not greater than the drop water absorbency of the split plane, in other words, when the absorption property of a surface layer is higher than that of an inner layer of the inkjet recording medium, the solvent such as water in the inkjet ink is diffused rapidly into the ink-receiving layer and the ink on the ink-receiving layer is immediately decreased, thereby improving the ink-drying property. Furthermore, since the solvent is absorbed by the substrate while the solvent is diffused, a problem described below is suppressed. This problem is so-called "bleed-through" generated when the ink is unevenly distributed and penetrated through the substrate and then reaching a rear surface (surface opposite to the printed surface) of the inkjet recording medium.

When the inkjet recording medium is peeled off from the surface of the ink-receiving layer in the direction of the thickness, the base paper is broken and exposed along a plane direction at a predetermined position in the direction of the thickness of the base paper since the strength of the base paper is lower than that of the ink-receiving layer. The exposed plane of the base paper is defined as the "split plane". As a method for peeling the ink-receiving layer, there are a method of splitting by adhering an adhesive tape and then peeling, and a method of splitting using a frozen peel tester (sheet splitter manufactured by Kumagai Riki Kogyo Co., Ltd.,) in a wet state.

The drop water absorbency of the ink-receiving layer is 200 seconds or less by blending 10 parts or less by weight of the binder based on 100 parts by weight of the ink-receiving layer, for example.

(Stockigt Sizing Degree)

The inkjet recording medium of the present invention has a Stockigt sizing degree of 5 seconds or less according to JIS-P-8122.

The Stockigt sizing degree is represented by the time (seconds). The higher the Stockigt sizing degree is, the lower the water absorption property is. The lower the Stockigt sizing degree is, the higher the water absorption property is.

In the present invention, the ink-drying property during the inkjet printing can be improved when the Stockigt sizing degree of 5 seconds or less, even though calcium carbonate having a poor ink absorption property is used as the main component of the pigment. If the Stockigt sizing degree of the inkjet recording medium exceeds 5 seconds, the ink-drying property is poor, undried ink is undesirably transferred from the inkjet recording medium after printing to the other inkjet recording medium to make blot, bleeding is generated on a periphery of the image, specifically, scuffing (feathering) at rims of characters and bleeding generated by mixing colors at a boundary between different colors are significant.

In order to improve the ink-drying property, the Stockigt sizing degree of the base paper is decreased in practice. However, the Stockigt sizing degree of the base paper is difficult to be measured from the product of the inkjet recording medium. When the Stockigt sizing degree of the base paper is low, the Stockigt sizing degree of the inkjet recording medium is also low. Therefore, the Stockigt sizing degree of the inkjet recording medium is specified.

The Stockigt sizing degree of the inkjet recording medium is 5 seconds or less by blending no internal sizing agent in the base paper or reducing the amount of the internal sizing agent. The same applies to the external sizing agent. In addition, the binder and the inkjet ink fixing agent in the ink-receiving layer increase the Stockigt sizing degree. In particular, the binder increases the Stockigt sizing degree due to its film forming property. In view of the above, it is required that the amount of the binder is 10 parts or less by weight and the amount of the inkjet ink fixing agent is 20 parts or less by weight.

(Contact Angle)

In the inkjet recording medium of the present invention, the ink-receiving layer preferably has a contact angle of 40 degrees or more or less than 40 degrees after 0.06 seconds from dropping 0.004 ml (4 μl) of distilled water.

The contact angle is represented by an angle (degree). The greater the contact angle is, the smaller the spread of the droplets is. The smaller the contact angle is, the greater the spread of the droplets is.

In the present invention, by adjusting the contact angle of the ink-receiving layer to 40 degrees or more, unevenness is less generated during the inkjet printing, bleeding is less generated on a periphery of the image, specifically, scuffing (feathering) at rims of characters and bleeding generated by mixing colors at a boundary between different colors are less generated, whereby a highly fine image is provided.

On the other hand, by adjusting the contact angle of the ink reiving layer to less than 40 degrees, the ink spreads, streak-through (streak like unprinted part) is easily suppressed, whereby the ink-drying property is improved. Therefore, the contact angle of the ink-receiving layer may be adjusted depending on the application.

The contact angle of the ink-receiving layer is 40 degrees or more by blending 1 parts or more by weight of the binder in the ink-receiving layer and 5 parts or more by weight of the inkjet ink fixing agent. On the other hand, the contact angle of the ink-receiving layer is less than 40 degrees by adding a surfactant to the ink-receiving layer. The surfactant used in the present invention is not particularly limited, but may be such as nonionic surfactant including an ester type nonionic surfactant, ether type nonionic surfactant and glycol type nonionic surfactant; anionic surfactant including a carboxylic acid type anionic surfactant and phosphoric ester type anionic surfactant; and silicone based surfactant including a polyoxyethylene-methyl polysiloxane copolymer and a poly (oxyethylene-oxymehtylene)-methyl polysiloxane copolymer. The glycol type nonionic surfactant is available as Surfynol 104P (product name) (acetylene glycol type nonionic surfactant) manufactured by San Nopco Limited.

(Layer Structure)

The ink-receiving layer of the present invention may be provided on only one side or both sides of the base paper. One or two or more ink-receiving layer(s) may be provided. In the present invention, a sufficient performance can be provided even with one ink-receiving layer. Therefore, one ink-receiving layer is preferable in terms of an improvement of operability and cost reduction.

Furthermore, in order to improve the smoothness of the ink-receiving layer, a precoat layer (undercoat layer) used in an offset printing medium, mainly containing the above mentioned pigment and binder may be provided between the ink-receiving layer and the base paper. In the present invention, when the precoat layer (undercoat layer) is provided, the outermost layer of the inkjet recording medium should be the ink-receiving layer.

(Coating Amount)

The coating amount of the ink-receiving layer of the present invention may be selected as appropriate depending on the desired quality and is not especially limited, but is preferably 0.5 g/m$^2$ to 20.0 g/m$^2$, more preferably 1.0 g/m$^2$ to 15.0 g/m$^2$ and especially preferably 3.0 g/m$^2$ to 10.0 g/m$^2$ per one surface in terms of a solid content. If the coating amount of the ink-receiving layer is less than 0.5 g/m$^2$ per one surface in terms of a solid content, it is difficult to coat the base paper sufficiently and no sufficient image quality and color development may be provided. On the other hand, when the coating amount of the ink-receiving layer is increased, a void amount in the ink-receiving layer is high, which results in a good ink absorption property during the inkjet printing. However, if the coating amount of the ink-receiving layer exceeds 15.0 g/m$^2$ per one surface in terms of a solid content, the ink-drying property may be decreased during the inkjet printing. If the coating amount of the ink-receiving layer exceeds 20.0 g/m$^2$ per one surface in terms of a solid content, the texture of the offset printing type is difficult to be provided, and the surface strength of the ink-receiving layer may be decreased.

(Coating Method)

In the present invention, a method of coating the ink-receiving layer on the base paper is not particularly limited and the ink-receiving layer may be coated on the base paper according to well-known conventional techniques. As a coating apparatus, a variety of apparatuses of a general coating apparatus such as a blade coater, a roll coater, an air knife coater, a bar coater, a gate roll coater, a curtain coater, a gravure coater, a flexographic gravure coater, a spray coater, a size press and the like can be used in on-machine or off-machine, as appropriate.

(Calendar Treating Methods)

In order to adjust the smoothness, the glossiness, the texture and the like of the surface in the inkjet recording medium of the present invention, after the ink-receiving layer is formed, a variety of calendar devices such as a hard nip calendar, a soft nip calendar, a super calendar, a shoe calendar and the like can be used in on-machine or off-machine, as appropriate. When a calendar treating is performed, a variety of conditions such as a processing temperature, a processing speed, a processing liner pressure, a processing stage number and a diameter and a material of a calendar roll can be adjusted, as appropriate.

When the basis weight of the inkjet recording medium is 30.0 g/m$^2$ to 70.0 g/m$^2$, the present invention is particularly effective. When the basis weight is a relative low value, i.e., 70.0 g/m$^2$ or less, the ink is easily accumulated in the ink-receiving layer and the cockling is likely to occur, if calcium carbonate having a poor ink absorption property is used as the main component of the pigment. However, since the ink-drying property of the inkjet recording medium according to the present invention is good, the cockling can be suppressed. Especially, when the ink-receiving layer is provided on both sides of the base paper, the cockling can be further suppressed.

EXAMPLES

The present invention is explained in further detail by presenting specific examples below, but the present invention is not limited by these examples. Further, unless otherwise specified, the terms "parts" and "%" described below indicate "parts by weight" and "% by weight", respectively.

Example 1

Base paper was prepared as described below:

(Base Paper)

0.5 parts of a paper strengthening agent (cationized starch), 0.55 parts of aluminum sulfate and 13 parts of calcium carbonate were added to 100 parts of the pulp material consisting of 87 parts of bleached hardwood kraft pulp (LBKP) having a CSF (Canadian Standard Freeness) of 390 ml and 13 parts of bleached softwood kraft pulp (NBKP) having the CSF of 480 ml to provide a paper stock. The base paper having a basis weight of 80 g/m$^2$ was made from the paper stock using a Fourdrinier papermaking machine.

A formulation including the following was agitated and dispersed to provide an ink-receiving layer coating color 1.

<Ink-Receiving Layer Coating Color 1>

Ground calcium carbonate (manufactured by FIMATEC LTD., product name: FMT-90, D50: 1.2 μm) 100.0 parts Fully saponified polyvinyl alcohol (manufactured by Kuraray Co., Ltd., product name: PVA117) 3.0 parts Fully saponified polyvinyl alcohol (manufactured by Kuraray Co., Ltd., product name: PVA103) 1.0 parts Inkjet ink-fixing agent (manufactured by Seiko PMC Corporation, product name: DK6800, polyamine epihalohydrin resin) 15.0 parts Water 32.0 parts Then, the ink-receiving layer coating color 1 was coated on one surface of the base paper using a blade coater such that the coating amount was 5.0 g/m$^2$ in terms of a solid content. After coating, the base paper was dried to produce an inkjet recording medium.

Example 2

A formulation including the following was agitated and dispersed to provide an ink-receiving layer coating color.

<Ink-Receiving Layer Coating Color 2>

Ground calcium carbonate (manufactured by Sankyo Seihun Co., Ltd.: product name: Escalon #200, D50: 4.9 μm) 100.0 parts Fully saponified polyvinyl alcohol 1 (manufactured by Kuraray Co., Ltd., product name: PVA117) 3.0 parts Fully saponified polyvinyl alcohol 2 (manufactured by Kuraray Co., Ltd., product name: PVA103) 1.0 parts Inkjet ink fixing agent (manufactured by Seiko PMC Corporation, product name: DK6800, polyamine epihalohydrin resin) 15.0 parts Water 32.0 parts Then, the ink-receiving layer coating color 2 was coated on one surface of the base paper using a blade coater such that the coating amount was 5.0 g/m$^2$ in terms of a solid content. After coating, the base paper was dried to produce an inkjet recording medium.

Example 3

A formulation including the following was agitated and dispersed to provide an ink-receiving layer coating color.

<Ink-Receiving Layer Coating Color 3>

Ground calcium carbonate (manufactured by Sankyo Seihun Co., Ltd.: product name: Escalon #200, D50: 4.9 μm) 100.0 parts Fully saponified polyvinyl alcohol 1 (manufactured by Kuraray Co., Ltd., product name: PVA117) 3.0 parts Fully saponified polyvinyl alcohol 2 (manufactured by Kuraray Co., Ltd., product name: PVA103) 1.0 parts Inkjet ink fixing agent (manufactured by Seiko PMC Corporation, product name: DK6800, polyamine epihalohydrin resin) 15.0 parts Surfactant (manufactured by San Nopco Limited, product name: Surfynol 104P) 1.0 parts Water 32.0 parts Then, the ink-receiving layer coating color 3 was coated on one surface of the base paper using a blade coater such that the coating amount was 5.0 g/m$^2$ in terms of a solid content. After coating, the base paper was dried to produce an inkjet recording medium.

Example 4

A formulation including the following was agitated and dispersed to provide an ink-receiving layer coating color.

<Ink-Receiving Layer Coating Color 4>

Ground calcium carbonate (manufactured by FIMATEC LTD.: product name: FMT-90, D50: 1.2 μm) 100.0 parts Fully saponified polyvinyl alcohol 1 (manufactured by Kuraray Co., Ltd., product name: PVA117) 3.0 parts Fully saponified polyvinyl alcohol 2 (manufactured by Kuraray Co., Ltd., product name: PVA103) 1.0 parts Inkjet ink fixing agent (manufactured by Seiko PMC Corporation, product name: DK6800, polyamine epihalohydrin resin) 15.0 parts Surfactant (manufactured by San Nopco Limited, product name: Surfynol 104P) 1.0 parts Water 32.0 parts Then, the ink-receiving layer coating color 4 was coated on one surface of the base paper using a blade coater such that the coating amount was 5.0 g/m$^2$ in terms of a solid content. After coating, the base paper was dried to produce an inkjet recording medium.

Example 5

An inkjet recording medium was produced as in Example 3 except that 0.5 parts of the surfactant (manufactured by San Nopco Limited., product name: Surfynol 104P) was used in the ink-receiving layer coating color 3 instead of using 1.0 parts of the surfactant.

Example 6

An inkjet recording medium was produced as in Example 1 except that 0.2 parts of a neutral rosin sizing agent (manufactured by Seiko PMC Corporation, product name: CC1401), 0.5 parts of a paper strengthening agent (cationized starch), 0.55 parts of aluminum sulfate and 13 parts of calcium carbonate were added to 100 parts of the pulp material consisting of 87 parts of bleached hardwood kraft pulp (LBKP) having a CSF of 390 ml and 13 parts of bleached softwood kraft pulp (NBKP) having the CSF of 480 ml to provide a paper stock.

Example 7

An inkjet recording medium was produced as in Example 3 except that 0.2 parts of a neutral rosin sizing agent (manufactured by Seiko PMC Corporation, product name: CC1401), 0.5 parts of a paper strengthening agent (cationized starch), 0.55 parts of aluminum sulfate and 13 parts of calcium carbonate were added to 100 parts of the pulp material consisting of 87 parts of bleached hardwood kraft pulp (LBKP) having a CSF of 390 ml and 13 parts of bleached softwood kraft pulp (NBKP) having the CSF of 480 ml to provide a paper stock.

Example 8

An inkjet recording medium was produced as in Example 1 except that 50.0 parts of calcium carbonate (manufactured by FIMATEC LTD., product name: FMT-90, D50: 1.2 μm) and 50.0 parts of silica (manufactured by Tosoh Silica Corporation, product name: AY-200) were used instead of 100.0 parts of calcium carbonate in the ink-receiving layer coating color 1.

Example 9

A formulation including the following was agitated and dispersed to provide an ink-receiving layer coating color.

<Ink-Receiving Layer Coating Color 5>

Ground calcium carbonate (manufactured by Sankyo Seihun Co., Ltd.: product name: Escalon #200, D50: 4.9 μm) 50.0 parts Silica (manufactured by Tosoh Silica Corporation, product name: AY-200) 50.0 parts Fully saponified polyvinyl alcohol 1 (manufactured by Kuraray Co., Ltd., product name: PVA117) 3.0 parts Fully saponified polyvinyl alcohol 2 (manufactured by Kuraray Co., Ltd., product name: PVA103) 1.0 parts Inkjet ink fixing agent (manufactured by Seiko PMC Corporation, product name: DK6800, polyamine epihalohydrin resin) 15.0 parts Surfactant (manufactured by San Nopco Limited, product name: Surfynol 104P) 0.5 parts Water 32.0 parts Then, the ink-receiving layer coating color 5 was coated on one surface of the base paper using a blade coater such that the coating amount was 5.0 g/m$^2$ in terms of a solid content. After coating, the base paper was dried to produce an inkjet recording medium.

Example 10

An inkjet recording medium was produced as in Example 1 except that the ink-receiving layer coating color 1 was coated such that the coating amount was 1.0 g/m$^2$ in terms of a solid content.

Example 11

An inkjet recording medium was produced as in Example 3 except that the ink-receiving layer coating color 3 was coated such that the coating amount was 1.0 g/m$^2$ in terms of a solid content.

Example 12

An inkjet recording medium was produced as in Example 1 except that the ink-receiving layer coating color 1 was coated such that the coating amount was 7.0 g/m$^2$ in terms of a solid content.

Example 13

An inkjet recording medium was produced as in Example 3 except that the ink-receiving layer coating color 3 was coated such that the coating amount was 7.0 g/m$^2$ in terms of a solid content.

Example 14

An inkjet recording medium was produced as in Example 1 except that the ink-receiving layer coating color 1 was coated such that the coating amount was 15.0 g/m$^2$ in terms of a solid content.

Example 15

An inkjet recording medium was produced as in Example 3 except that the ink-receiving layer coating color 3 was coated such that the coating amount was 15.0 g/m$^2$ in terms of a solid content.

Example 16

An inkjet recording medium was produced as in Example 1 except that 100 parts of calcium carbonate (manufactured by Sankyo Seihun Co., Ltd.: product name: Escalon special grade, D50: 13.0 μm) used instead of 100.0 parts of calcium carbonate in the ink-receiving layer coating color 1.

Example 17

An inkjet recording medium was produced as in Example 3 except that 100.0 parts of ground calcium carbonate (manufactured by Sankyo Seihun Co., Ltd.: product name: Escalon special grade, D50: 13.0 μm) used instead of 100.0 parts of ground calcium carbonate in the ink-receiving layer coating color 3.

Example 18

An inkjet recording medium was produced as in Example 2 except that 5.0 parts of the inkjet ink fixing agent was used in the ink-receiving layer coating color 2 instead of using 15.0 parts of the inkjet ink fixing agent and that 3.0 parts of fully saponified polyvinyl alcohol 2 (manufactured by Kuraray Co., Ltd., product name: PVA103) was used instead of using 1.0 parts thereof.

Example 19

An inkjet recording medium was produced as in Example 2 except that 11.0 parts of the inkjet ink fixing agent was used in the ink-receiving layer coating color 2 instead of using 15.0 parts of the inkjet ink fixing agent.

Example 20

An inkjet recording medium was produced as in Example 2 except that 20.0 parts of the inkjet ink fixing agent was used in the ink-receiving layer coating color 2 instead of using 15.0 parts of the inkjet ink fixing agent.

Example 21

An inkjet recording medium was produced as in Example 2 except that 26.0 parts of the inkjet ink fixing agent was used in the ink-receiving layer coating color 2 instead of using 15.0 parts of the inkjet ink fixing agent.

Example 22

An inkjet recording medium was produced as in Example 2 except that 0.5 parts of fully saponified polyvinyl alcohol 1 (manufactured by Kuraray Co., Ltd., product name: PVA117) was used in the ink-receiving layer coating color 2 instead of using 3.0 part thereof and that 0.5 parts of fully saponified polyvinyl alcohol 2 (manufactured by Kuraray Co., Ltd., product name: PVA103) was used instead of using 1.0 parts thereof.

Example 23

An inkjet recording medium was produced as in Example 2 except that 1.0 parts of fully saponified polyvinyl alcohol 1 (manufactured by Kuraray Co., Ltd., product name: PVA117) was used in the ink-receiving layer coating color 2 instead of using 3.0 part thereof.

Example 24

An inkjet recording medium was produced as in Example 2 except that 7.5 parts of fully saponified polyvinyl alcohol 1 (manufactured by Kuraray Co., Ltd., product name: PVA117) was used in the ink-receiving layer coating color 2 instead of using 3.0 part thereof and that 2.5 parts of fully saponified polyvinyl alcohol 2 (manufactured by Kuraray Co., Ltd., product name: PVA103) was used instead of using 1.0 parts thereof.

Example 25

An inkjet recording medium was produced as in Example 2 except that 9.5 parts of fully saponified polyvinyl alcohol 1 (manufactured by Kuraray Co., Ltd., product name: PVA117) was used in the ink-receiving layer coating color 2 instead of using 3.0 part thereof and that 3.5 parts of fully saponified polyvinyl alcohol 2 (manufactured by Kuraray Co., Ltd., product name: PVA103) was used instead of using 1.0 parts thereof.

Example 26

A formulation including the following was agitated and dispersed to provide an ink-receiving layer coating color.

<Ink-Receiving Layer Coating Color 6>

Ground calcium carbonate (manufactured by Sankyo Seihun Co., Ltd.: product name: Escalon #200, D50: 4.9 μm) 100.0 parts Starch urea phosphate (manufactured by Sanwa Starch Co., Ltd., product name: PLV-500) 13.0 parts Inkjet ink fixing agent (manufactured by Seiko PMC Corporation, product name: DK6800, polyamine epihalohydrin resin) 15.0 parts Water 32.0 parts Then, the ink-receiving layer coating color 6 was coated on one surface of the base paper using a blade coater such that the coating amount was 5.0 g/m$^2$ in terms of a solid content. After coating, the base paper was dried to produce an inkjet recording medium.

Example 27

An inkjet recording medium was produced as in Example 2 except that a basis weight of a base paper had 55 g/m$^2$.

Example 28

An inkjet recording medium was produced as in Example 2 except that a basis weight of a base paper had 45 g/m$^2$.

Comparative Example 1

An inkjet recording medium was produced as in Example 1 except that 0 part of calcium carbonate was used in the ink-receiving layer coating color 1.

Comparative Example 2

An inkjet recording medium was produced as in Example 3 except that 0 part of calcium carbonate was used in the ink-receiving layer coating color 3.

Comparative Example 3

The same procedure in Example 1 was repeated except that 0 part of fully saponified polyvinyl alcohol 1 and 0 part of fully saponified polyvinyl alcohol 2 were used in the ink-receiving layer coating color 1. However, the pigment could not be held on the substrate and no ink-receiving layer was formed, thereby producing no inkjet recording medium (coating is impossible).

Comparative Example 4

An inkjet recording medium was produced as in Example 1 except that 0 part of the inkjet ink fixing agent was used in the ink-receiving layer coating color 1.

Comparative Example 5

An inkjet recording medium was produced as in Example 3 except that 0 part of the inkjet ink fixing agent was used in the ink-receiving layer coating color 3.

Comparative Example 6

An inkjet recording medium was produced as in Example 1 except that 40.0 parts of calcium carbonate (manufactured by FIMATEC LTD., product name: FMT-90, D50: 1.2 μm) and 60.0 parts of silica (manufactured by Tosoh Silica Corporation, product name: AY-200) were used instead of 100.0 parts of calcium carbonate in the ink-receiving layer coating color 1.

Comparative Example 7

An inkjet recording medium was produced as in Example 3 except that 40.0 parts of ground calcium carbonate (manufactured by Sankyo Seihun Co., Ltd.: product name: Escalon #200, D50: 4.9 μm) and 60.0 parts of silica (manufactured by Tosoh Silica Corporation, product name: AY-200) were used instead of 100.0 parts of ground calcium carbonate in the ink-receiving layer coating color 3.

Comparative Example 8

An inkjet recording medium was produced as in Example 1 except that 20.0 parts of fully saponified polyvinyl alcohol 1 (manufactured by Kuraray Co., Ltd., product name: PVA117) was used in the ink-receiving layer coating color 1 instead of using 3.0 part thereof.

Comparative Example 9

An inkjet recording medium was produced as in Example 1 except that 0.4 parts of a neutral rosin sizing agent (manufactured by Seiko PMC Corporation, product name: CC1401), 0.5 parts of a paper strengthening agent (cationized starch), 0.55 parts of aluminum sulfate and 13 parts of calcium carbonate were added to 100 parts of the pulp material consisting of 87 parts of bleached hardwood kraft pulp (LBKP) having a CSF of 390 ml and 13 parts of bleached softwood kraft pulp (NBKP) having the CSF of 480 ml to provide a paper stock, and that 10.0 parts of fully saponified polyvinyl alcohol 1 (manufactured by Kuraray Co., Ltd., product name: PVA117) was used in the ink-receiving layer coating color 1 instead of using 3.0 part thereof.

Comparative Example 10

An inkjet recording medium was produced as in Example 2 except that 0.25 parts of a neutral rosin sizing agent (manufactured by Seiko PMC Corporation, product name: CC1401), 0.5 parts of a paper strengthening agent (cationized starch), 0.55 parts of aluminum sulfate and 13 parts of calcium carbonate were added to 100 parts of the pulp material consisting of 87 parts of bleached hardwood kraft pulp (LBKP) having a CSF of 390 ml and 13 parts of bleached softwood kraft pulp (NBKP) having the CSF of 480 ml to provide a paper stock, and that 10.0 parts of fully saponified polyvinyl alcohol 1 (manufactured by Kuraray Co., Ltd., product name: PVA117) was used in the ink-receiving layer coating color 2 instead of using 3.0 part thereof.

Comparative Example 11

An inkjet recording medium was produced as in Example 2 except that 4.0 parts of the inkjet ink fixing agent was used in the ink-receiving layer coating color 2 instead of using 15.0 parts of the inkjet ink fixing agent.

Comparative Example 12

An inkjet recording medium was produced as in Example 2 except that 28.0 parts of the inkjet ink fixing agent was used in the ink-receiving layer coating color 2 instead of using 15.0 parts of the inkjet ink fixing agent.

Comparative Example 13

The same procedure in Example 2 was repeated except that 0.5 parts of fully saponified polyvinyl alcohol 1 (manufactured by Kuraray Co., Ltd., product name: PVA117) was used instead of using 3.0 parts thereof and 0 part of fully saponified polyvinyl alcohol 2 (manufactured by Kuraray Co., Ltd., product name: PVA103) were used instead of using 1.0 parts thereof in the ink-receiving layer coating color 2. However, the pigment was difficult to be held on the substrate and no homogeneous ink-receiving layer was formed, thereby producing no usable (inkjet printable) inkjet recording medium (in other words, unusable).

Comparative Example 14

An inkjet recording medium was produced as in Example 2 except that 10.5 parts of fully saponified polyvinyl alcohol 1 (manufactured by Kuraray Co., Ltd., product name: PVA117) was used instead of using 3.0 part thereof and that 3.5 parts of fully saponified polyvinyl alcohol 2 (manufactured by Kuraray Co., Ltd., product name: PVA103) was used instead of using 1.0 parts thereof in the ink-receiving layer coating color 2.

Each inkjet recording medium produced was evaluated as follows.

<Color Development Property>

Each inkjet recording medium produced was solid printed in black, cyan, magenta and yellow using a commercially available dye inkjet printer (trade name: PM-A940, manufactured by Seiko Epson Corporation, printing conditions: plain paper/standard mode). After one day, a print density of each color was measured using a Macbeth densitometer (Gretag Macbeth RD-19) and was evaluated for the color development based on the total values of four colors.

<Uneven Printing (Image Quality)>

Each inkjet recording medium produced was solid printed in red and green adjacent (each size: 2 cm×3 cm) using the commercially available dye inkjet printer (trade name: PM- A940, manufactured by Seiko Epson Corporation, printing conditions: plain paper/standard mode), and was evaluated according to the following criteria.

Excellent: Homogeneous solid without unevenness, no bleeding at the periphery of the solid portion and at the boundary between the two colors is observed.

Good: A little unevenness is observed partially but almost evenly solid, no bleeding at the periphery of the solid portion and at the boundary between the two colors is observed.

Not bad: Partial unevenness is observed, or bleeding at the periphery of the solid portion and at the boundary between the two colors is observed.

Bad: Spotted unevenness is dominant, or bleeding at the periphery of the solid portion and at the boundary between the two colors is dominant.

<Streak-Through>

Each inkjet recording medium produced was solid printed in magenta (size: 2 cm×3 cm) using the commercially available pigment inkjet printer (trade name: PX-V630, manufactured by Seiko Epson Corporation, printing conditions: super fine/high quality mode), and was evaluated for a streak like unprinted part (streak-through) according to the following criteria.

Excellent: No streak is observed and evenly solid.

Good: A little streaks are observed partially but almost evenly solid.

Not bad: Partial streaks are observed.

Bad: Streak is dominant.

<Ink-Drying Property>

Each inkjet recording medium produced was solid printed in black (size: 2 cm×3 cm) using the commercially available pigment inkjet printer (trade name: PX-V630, manufactured by Seiko Epson Corporation, printing conditions: super fine/high quality mode). After 5 seconds or 10 seconds of printing, one fine paper having a basis weight of 80 g/m$^2$ was overlaid on a printed surface and was applied a pressure using a rubber roller having a diameter of 10 cm, a width of 13 cm and a weight of 2.7 kg. Thereafter, a color density of a black solid transferred to the fine paper was measured using a Macbeth densitometer (Gretag Macbeth RD-19) and was evaluated according to the following criteria.

Excellent: Color density of the black solid transferred to the fine paper is less than 0.10.

Good: Color density of the black solid transferred to the fine paper is 0.10 to less than 0.15.

Not bad: Color density of the black solid transferred to the fine paper is 0.15 to less than 0.20.

Bad; Color density of the black solid transferred to the fine paper is 0.20 or more.

<Cockling>

The inkjet recording medium produced was solid printed in green (size: 2 cm×15 cm) using the commercially available dye inkjet printer (trade name: PM-A940, manufactured by Seiko Epson Corporation, printing conditions: plain paper/standard mode), and was evaluated for cockling (waviness) occurrence according to the following criteria.

Good: Waviness is small, and almost no unevenness is observed.

Not bad: Waviness is slightly great, and more or less unevenness is significant.

Bad: Waviness is great, and unevenness is significant.

<Water Resistance>

The inkjet recording medium produced was printed characters having a font size of 10 point in magenta using the commercially available dye inkjet printer (trade name: PM-A940, manufactured by Seiko Epson Corporation, printing conditions: plain paper/standard mode). After one day, water was dropped onto the characters to evaluate a bleeding degree of the characters according to the following criteria.

Good: No bleeding is observed.

Not bad: Bleeding is observed but characters are legible.

Bad: Bleeding is observed and characters are illegible.

<Texture>

Each inkjet recording medium produced was evaluated according to the following criteria by visual observation for a surface feeling of the ink-receiving layer surface.

Good: Texture of the offset printing type is obtained.

Not bad: Texture close to the offset printing type is obtained.

Bad: No texture of the offset printing type is obtained.

<Writing Suitability>

As to each inkjet recording medium produced, pencil writing was done on the ink-receiving layer surface according to JIS KJIS5600-5-4 (ISO/DIN 15184) Pencil hardness test and was evaluated for the writing suitability at a writable minimum hardness.

The "writing suitability" is a measure of "easy to write" when writing with writing instrument of a pencil, a ball-point pen, a fountain pen or the like on the ink-receiving layer. Since it is difficult to write with a harder pencil, the writing suitability is good if writing is done with the harder pencil. The pencils used for the evaluation are described below in order from the softer pencil. When writing was done with the pencil hardness of H or more, the writing suitability was considered good.

(Soft) 6B-5B-4B-3B-2B-B-HB-F-H-2H-3H-4H-5H-6H (Hard)

The drop water absorbency was measured as described above. Note that, when the drop water absorbency of the split plane was measured, an adhesive tape was adhered, peeled and split to peel the ink-receiving layer.

The method (procedure) of splitting by adhering an adhesive tape and then peeling was as follows:

1) Prepare an inkjet recording medium (size: 15 cm×7 cm).

2) An adhesive tape (manufactured by Nitto Denko Co., Ltd., a polyester adhesive tape, No. 31B) is adhered to cover the entire surface of the ink-receiving layer side of the inkjet recording medium. A periphery of the adhesive tape is protruded over a periphery of the inkjet recording medium outward about 1 cm. The adhesive tape protruded is bent upward from an upper end of the inkjet recording medium to provide a handle.

3) The handle of the adhesive tape adhered is taken to peel off the adhesive tape upward.

4) If the base paper is not exposed by one peeling operation, repeat 3) and 4) until the base paper is exposed.

The Stockigt sizing degree and the contact angle of the inkjet recording medium were measured as described above.

Tables 1 to 4 show the paper quality and the evaluation results of the inkjet recording medium obtained in Examples and Comparative Examples.

TABLE 1

| | Base paper | Ink-receiving layer | | | | | |
|---|---|---|---|---|---|---|---|
| | Sizing agent (neutral rosin) | Total amount of all | Pigment 1 Calcium carbonate | | Pigment 2 | | Percentage to ink- |
| | amount (parts) | components (parts) | Amount (parts) | D50 (μm) | Type | Amount (parts) | receiving layer (parts) |
| Example 1 | 0 | 119 | 100 | 1.2 | No | 0 | 84 |
| Example 2 | 0 | 119 | 100 | 4.9 | No | 0 | 84 |
| Example 3 | 0 | 120 | 100 | 4.9 | No | 0 | 83 |
| Example 4 | 0 | 120 | 100 | 1.2 | No | 0 | 83 |
| Example 5 | 0 | 119.5 | 100 | 4.9 | No | 0 | 84 |
| Example 6 | 0.2 | 119 | 100 | 1.2 | No | 0 | 84 |
| Example 7 | 0.2 | 120 | 100 | 1.2 | No | 0 | 83 |
| Example 8 | 0 | 119 | 50 | 1.2 | Silica | 50 | 84 |
| Example 9 | 0 | 119.5 | 50 | 4.9 | Silica | 50 | 84 |
| Example 10 | 0 | 119 | 100 | 1.2 | No | 0 | 84 |
| Example 11 | 0 | 120 | 100 | 4.9 | No | 0 | 83 |
| Example 12 | 0 | 119 | 100 | 1.2 | No | 0 | 84 |
| Example 13 | 0 | 120 | 100 | 4.9 | No | 0 | 83 |
| Example 14 | 0 | 119 | 100 | 1.2 | No | 0 | 84 |
| Example 15 | 0 | 120 | 100 | 4.9 | No | 0 | 83 |
| Example 16 | 0 | 119 | 100 | 13.0 | No | 0 | 84 |
| Example 17 | 0 | 120 | 100 | 13.0 | No | 0 | 83 |
| Example 18 | 0 | 111 | 100 | 4.9 | No | 0 | 90 |
| Example 19 | 0 | 115 | 100 | 4.9 | No | 0 | 87 |
| Example 20 | 0 | 124 | 100 | 4.9 | No | 0 | 81 |
| Example 21 | 0 | 130 | 100 | 4.9 | No | 0 | 77 |
| Example 22 | 0 | 116 | 100 | 4.9 | No | 0 | 86 |
| Example 23 | 0 | 117 | 100 | 4.9 | No | 0 | 85 |
| Example 24 | 0 | 125 | 100 | 4.9 | No | 0 | 80 |
| Example 25 | 0 | 128 | 100 | 4.9 | No | 0 | 78 |
| Example 26 | 0 | 128 | 100 | 4.9 | No | 0 | 78 |
| Example 27 | 0 | 119 | 100 | 4.9 | No | 0 | 84 |
| Example 28 | 0 | 119 | 100 | 4.9 | No | 0 | 84 |

| | Ink-receiving layer | | | | | |
|---|---|---|---|---|---|---|
| | Inkjet ink-fixing agent | | Binder | | | Coating amount |
| | Amount (parts) | Percentage to ink-receiving layer (parts) | Amount (parts) | Percentage to ink-receiving layer (parts) | Amount of surfactant (parts) | of one surface (g/m2) |
| Example 1 | 15 | 13 | 4 | 3 | 0 | 5.0 |
| Example 2 | 15 | 13 | 4 | 3 | 0 | 5.0 |
| Example 3 | 15 | 13 | 4 | 3 | 1 | 5.0 |
| Example 4 | 15 | 13 | 4 | 3 | 1 | 5.0 |
| Example 5 | 15 | 13 | 4 | 3 | 0.5 | 5.0 |
| Example 6 | 15 | 13 | 4 | 3 | 0 | 5.0 |
| Example 7 | 15 | 13 | 4 | 3 | 1 | 5.0 |
| Example 8 | 15 | 13 | 4 | 3 | 0 | 5.0 |
| Example 9 | 15 | 13 | 4 | 3 | 0.5 | 5.0 |
| Example 10 | 15 | 13 | 4 | 3 | 0 | 1.0 |
| Example 11 | 15 | 13 | 4 | 3 | 1 | 1.0 |
| Example 12 | 15 | 13 | 4 | 3 | 0 | 7.0 |
| Example 13 | 15 | 13 | 4 | 3 | 1 | 7.0 |
| Example 14 | 15 | 13 | 4 | 3 | 0 | 15.0 |
| Example 15 | 15 | 13 | 4 | 3 | 1 | 15.0 |
| Example 16 | 15 | 13 | 4 | 3 | 0 | 5.0 |
| Example 17 | 15 | 13 | 4 | 3 | 1 | 5.0 |
| Example 18 | 5 | 5 | 6 | 5 | 0 | 5.0 |
| Example 19 | 11 | 10 | 4 | 3 | 0 | 5.0 |
| Example 20 | 20 | 16 | 4 | 3 | 0 | 5.0 |
| Example 21 | 26 | 20 | 4 | 3 | 0 | 5.0 |
| Example 22 | 15 | 13 | 1 | 1 | 0 | 5.0 |
| Example 23 | 15 | 13 | 2 | 2 | 0 | 5.0 |
| Example 24 | 15 | 12 | 10 | 8 | 0 | 5.0 |
| Example 25 | 15 | 12 | 13 | 10 | 0 | 5.0 |
| Example 26 | 15 | 12 | 13 | 10 | 0 | 5.0 |
| Example 27 | 15 | 13 | 4 | 3 | 0 | 5.0 |
| Example 28 | 15 | 13 | 4 | 3 | 0 | 5.0 |

TABLE 2

| | Base paper | Ink-receiving layer | | | | | |
|---|---|---|---|---|---|---|---|
| | Sizing agent (neutral rosin) | Total amount of all | Pigment 1 Calcium carbonate | | Pigment 2 | | Percentage to ink- |
| | amount (parts) | components (parts) | Amount (parts) | D50 (μm) | Type | Amount (parts) | receiving layer (parts) |
| Comp-Example 1 | 0 | 19 | 0 | — | No | 0 | 0 |
| Comp-Example 2 | 0 | 20 | 0 | — | No | 0 | 0 |
| Comp-Example 3 | 0 | 115 | 100 | 1.2 | No | 0 | 87 |
| Comp-Example 4 | 0 | 104 | 100 | 1.2 | No | 0 | 96 |
| Comp-Example 5 | 0 | 105 | 100 | 1.2 | No | 0 | 95 |
| Comp-Example 6 | 0 | 119 | 40 | 1.2 | Silica | 60 | 84 |
| Comp-Example 7 | 0 | 119.5 | 40 | 4.9 | Silica | 60 | 84 |
| Comp-Example 8 | 0 | 136 | 100 | 1.2 | No | 0 | 74 |
| Comp-Example 9 | 0.4 | 126 | 100 | 1.2 | No | 0 | 79 |
| Comp-Example 10 | 0.25 | 126 | 100 | 4.9 | No | 0 | 79 |
| Comp-Example 11 | 0 | 108 | 100 | 4.9 | No | 0 | 93 |
| Comp-Example 12 | 0 | 132 | 100 | 4.9 | No | 0 | 76 |
| Comp-Example 13 | 0 | 115.5 | 100 | 4.9 | No | 0 | 87 |
| Comp-Example 14 | 0 | 129 | 100 | 4.9 | No | 0 | 78 |

| | Ink-receiving layer | | | | | |
|---|---|---|---|---|---|---|
| | Inkjet ink-fixing agent | | Binder | | | Coating amount |
| | Amount (parts) | Percentage to ink-receiving layer (parts) | Amount (parts) | Percentage to ink-receiving layer (parts) | Amount of surfactant (parts) | of one surface (g/m2) |
| Comp-Example 1 | 15 | 79 | 4 | 21 | 0 | 5.0 |
| Comp-Example 2 | 15 | 75 | 4 | 20 | 1 | 5.0 |
| Comp-Example 3 | 15 | 13 | 0 | 0 | 0 | — |
| Comp-Example 4 | 0 | 0 | 4 | 4 | 0 | 5.0 |
| Comp-Example 5 | 0 | 0 | 4 | 4 | 1 | 5.0 |
| Comp-Example 6 | 15 | 13 | 4 | 3 | 0 | 5.0 |
| Comp-Example 7 | 15 | 13 | 4 | 3 | 0.5 | 5.0 |
| Comp-Example 8 | 15 | 11 | 21 | 15 | 0 | 5.0 |
| Comp-Example 9 | 15 | 12 | 11 | 9 | 0 | 5.0 |
| Comp-Example 10 | 15 | 12 | 11 | 9 | 0 | 5.0 |
| Comp-Example 11 | 4 | 4 | 4 | 4 | 0 | 5.0 |
| Comp-Example 12 | 28 | 21 | 4 | 3 | 0 | 5.0 |
| Comp-Example 13 | 15 | 13 | 0.5 | 0.4 | 0 | 5.0 |
| Comp-Example 14 | 15 | 12 | 14 | 11 | 0 | 5.0 |

TABLE 3

| | Inkjet recording medium | | | | | | |
|---|---|---|---|---|---|---|---|
| | Properties | | | | Quality evaluation | | |
| | Drop water absorbency (sec) | | Contact angle of ink-receiving | Stockigt sizing | color | Uneven printing | |
| | Ink-receiving layer | Split plane | layer (degrees) | degree (sec) | devel-opment | (image quality) | Streak through |
| Example 1 | 174 | 130 | 44 | 0 | 4.44 | Good | Good |
| Example 2 | 174 | 130 | 44 | 0 | 4.44 | Good | Good |
| Example 3 | 127 | 130 | 26 | 0 | 4.50 | Good | Excellent |
| Example 4 | 138 | 130 | 30 | 0 | 4.49 | Not bad | Excellent |
| Example 5 | 146 | 130 | 35 | 0 | 4.49 | Good | Good |
| Example 6 | 170 | 250 | 44 | 5 | 4.43 | Good | Good |
| Example 7 | 136 | 250 | 30 | 5 | 4.47 | Not bad | Excellent |
| Example 8 | 131 | 130 | 40 | 1 | 4.46 | Excellent | Good |
| Example 9 | 116 | 130 | 32 | 1 | 4.51 | Excellent | Good |
| Example 10 | 143 | 130 | 42 | 0 | 4.26 | Not bad | Excellent |
| Example 11 | 103 | 130 | 24 | 0 | 4.40 | Not bad | Excellent |
| Example 12 | 179 | 130 | 45 | 1 | 4.50 | Good | Good |
| Example 13 | 128 | 130 | 27 | 1 | 4.53 | Good | Excellent |
| Example 14 | 193 | 130 | 48 | 2 | 4.52 | Excellent | Not bad |
| Example 15 | 162 | 130 | 31 | 2 | 4.55 | Excellent | Good |
| Example 16 | 175 | 130 | 43 | 0 | 4.45 | Not bad | Good |

TABLE 3-continued

| | | | | | | | |
|---|---|---|---|---|---|---|---|
| Example 17 | 119 | 130 | 21 | 0 | 4.48 | Not bad | Excellent |
| Example 18 | 170 | 130 | 43 | 0 | 4.35 | Good | Excellent |
| Example 19 | 172 | 130 | 44 | 0 | 4.40 | Good | Excellent |
| Example 20 | 177 | 130 | 45 | 0 | 4.47 | Good | Good |
| Example 21 | 180 | 130 | 46 | 0 | 4.50 | Good | Not bad |
| Example 22 | 172 | 130 | 43 | 0 | 4.33 | Good | Excellent |
| Example 23 | 173 | 130 | 43 | 0 | 4.40 | Good | Excellent |
| Example 24 | 180 | 130 | 59 | 2 | 4.54 | Excellent | Good |
| Example 25 | 184 | 130 | 67 | 4 | 4.58 | Excellent | Good |
| Example 26 | 181 | 130 | 61 | 2 | 4.55 | Good | Not bad |
| Example 27 | 174 | 130 | 44 | 0 | 4.44 | Good | Good |
| Example 28 | 174 | 130 | 44 | 0 | 4.44 | Good | Good |

| | Inkjet recording medium | | | | | |
|---|---|---|---|---|---|---|
| | Quality evaluation | | | | | |
| | Ink-drying property | | | Water | | |
| | After 5 seconds | After 10 seconds | Cockling | resis-tance | Texture | Water suitability |
| Example 1 | Good | Excellent | Good | Good | Good | 6H |
| Example 2 | Good | Excellent | Good | Good | Good | 6H |
| Example 3 | Excellent | Excellent | Good | Good | Good | 6H |
| Example 4 | Excellent | Excellent | Good | Good | Good | 6H |
| Example 5 | Good | Excellent | Good | Good | Good | 6H |
| Example 6 | Not bad | Not bad | Not bad | Good | Good | 6H |
| Example 7 | Excellent | Excellent | Not bad | Good | Good | 6H |
| Example 8 | Excellent | Excellent | Good | Good | Not bad | 3H |
| Example 9 | Excellent | Excellent | Good | Good | Not bad | 3H |
| Example 10 | Excellent | Excellent | Not bad | Good | Good | 6H |
| Example 11 | Excellent | Excellent | Not bad | Good | Good | 6H |
| Example 12 | Good | Excellent | Good | Good | Good | 6H |
| Example 13 | Excellent | Excellent | Good | Good | Good | 6H |
| Example 14 | Not bad | Good | Good | Good | Good | 6H |
| Example 15 | Not bad | Good | Good | Good | Good | 6H |
| Example 16 | Good | Excellent | Good | Good | Not bad | 6H |
| Example 17 | Excellent | Excellent | Good | Good | Not bad | 6H |
| Example 18 | Excellent | Excellent | Good | Not bad | Good | 6H |
| Example 19 | Excellent | Excellent | Good | Good | Good | 6H |
| Example 20 | Good | Excellent | Good | Good | Good | 6H |
| Example 21 | Not bad | Good | Good | Good | Good | 6H |
| Example 22 | Excellent | Excellent | Good | Good | Good | 6H |
| Example 23 | Excellent | Excellent | Good | Good | Good | 6H |
| Example 24 | Good | Excellent | Good | Good | Good | 6H |
| Example 25 | Not bad | Good | Not bad | Good | Good | 6H |
| Example 26 | Good | Good | Not bad | Good | Good | 6H |
| Example 27 | Good | Excellent | Good | Good | Good | 6H |
| Example 28 | Good | Excellent | Not bad | Good | Good | 6H |

TABLE 4

| | Inkjet recording medium | | | |
|---|---|---|---|---|
| | Properties | | | |
| | Drop water absorbency (sec) | | Contact angle of ink-receiving | Stockigt sizing |
| | Ink-receiving layer | Split plane | layer (degrees) | degree (sec) |
| Comp-Example 1 | 136 | 130 | 41 | 0 |
| Comp-Example 2 | 99 | 130 | 27 | 0 |
| Comp-Example 3 | Coating was impossible and sample could not be produced | | | |
| Comp-Example 4 | 169 | 130 | 43 | 0 |
| Comp-Example 5 | 133 | 130 | 29 | 0 |
| Comp-Example 6 | 121 | 130 | 35 | 1 |
| Comp-Example 7 | 107 | 130 | 28 | 1 |
| Comp-Example 8 | 243 | 130 | 75 | 5 |
| Comp-Example 9 | 181 | 600 | 66 | 13 |
| Comp-Example 10 | 180 | 380 | 65 | 7 |
| Comp-Example 11 | 170 | 130 | 43 | 0 |
| Comp-Example 12 | 202 | 130 | 48 | 0 |

TABLE 4-continued

| | | | | | | | | | |
|---|---|---|---|---|---|---|---|---|---|
| Comp-Example 13 | Coating was possible but ink receiving layer was peeled | | | | | | | | |
| Comp-Example 14 | 215 | 130 | 72 | | | 5 | | | |
| | Inkjet recording medium | | | | | | | | |
| | Quality evaluation | | | | | | | | |
| | color | Uneven printing | | Ink-drying property | | | Water | | Writing |
| | devel-opment | (image quality) | Streak through | After 5 seconds | After 10 seconds | Cock-ling | resis-tance | Tex-ture | suit-ability |
| Comp-Example 1 | 3.84 | Bad | Excellent | Excellent | Excellent | Bad | Good | Bad | 6H |
| Comp-Example 2 | 3.86 | Bad | Excellent | Excellent | Excellent | Bad | Good | Bad | 6H |
| Comp-Example 3 | Coating was impossible and sample could not be produced | | | | | | | | |
| Comp-Example 4 | 4.19 | Not bad | Excellent | Not bad | Good | Good | Bad | Good | 6H |
| Comp-Example 5 | 4.24 | Not bad | Good | Not bad | Good | Not bad | Bad | Good | 6H |
| Comp-Example 6 | 4.49 | Excellent | Excellent | Excellent | Excellent | Good | Good | Bad | F |
| Comp-Example 7 | 4.53 | Excellent | Not bad | Excellent | Excellent | Good | Good | Bad | F |
| Comp-Example 8 | 4.48 | Bad | Excellent | Bad | Bad | Not bad | Good | Good | 6H |
| Comp-Example 9 | 4.49 | Bad | Excellent | Bad | Bad | Bad | Good | Good | 6H |
| Comp-Example 10 | 4.48 | Not bad | Excellent | Bad | Not bad | Not bad | Good | Good | 6H |
| Comp-Example 11 | 4.31 | Good | Excellent | Excellent | Excellent | Good | Bad | Good | 6H |
| Comp-Example 12 | 4.51 | Good | Bad | Bad | Good | Not bad | Good | Good | 6H |
| Comp-Example 13 | Coating was difficult and printable sample coult not be produced | | | | | | | | |
| Comp-Example 14 | 4.61 | Bad | Good | Bad | Not bad | Not bad | Good | Good | 6H |

Table 1 to Table 4 clearly show that in Comparative Example 1 and Comparative Example 2 where each ink-receiving layer contained no pigment, the uneven printing (image quality) and cockling were induced and no texture of the offset printing type was obtained.

In Examples 8 and 9 where 50% by weight of calcium carbonate was contained in terms of a solid content based on a total amount of the pigment contained in the ink-receiving layer, the hardness of the pencil writable was low as compared to other Examples where exceeding 50% by weight of calcium carbonate was contained in terms of a solid content, but there is no practical problem.

In Comparative Example 3 where the ink-receiving layer contained no binder, it was unable to coat the ink-receiving layer. In Comparative Example 13 where less than 1 part by weight of the binder was contained based on 100 parts by weight of the ink-receiving layer, it was able to coat the ink-receiving layer, but the ink-receiving layer was peeled off during handling and no print was made.

In Comparative Example 4 and Comparative Example 5 where each ink-receiving layer contained no inkjet ink fixing agent and in Comparative Example 11 where the content of the inkjet ink fixing agent was less than 5 parts by weight based on 100 parts by weight of the ink-receiving layer, the water resistance was poor.

In Comparative Example 6 and Comparative Example 7 where less than 50% by weight of calcium carbonate was contained based on a total amount of the pigment in the ink-receiving layer, the texture of offset printing type was not obtained, the hardness of the pencil writable was low and the writing suitability was poor.

In Comparative Example 8 and Comparative Example 14 where exceeding 10 parts by weight of the binder was contained based on 100 parts by weight of the ink-receiving layer, the drop water absorbency of the ink-receiving layer exceeds 200 seconds, the water absorption of the ink-receiving layer decreases to cause the uneven printing (image quality) and the ink-drying property was poor. In Comparative Example 8 and Comparative Example 14 where the proportion of the binder was large, unevenness and bleeding were dominant, resulting in the uneven printing (image quality). No streak-through was induced, however, since the bleeding was remarkable.

In Comparative Example 9 and Comparative Example 10 where exceeding 0.2 parts by weight of the sizing agent was added in the base paper, the Stockigt sizing degree exceeded 5 seconds and the ink-drying property was poor. In addition, in Comparative Example 9 where the proportion of the sizing agent was larger than that in Comparative Example 10 and the Stockigt sizing degree was much greater than 5 seconds, the uneven printing (image quality) and the cockling were also poor.

In Comparative Example 12 where exceeding 20 parts by weight of the inkjet ink fixing agent was contained based on 100 parts by weight of he ink-receiving layer, the streak-through was induced.

What is claimed is:

1. An inkjet recording medium, comprising an ink-receiving layer containing a pigment, a binder and an inkjet ink-fixing agent comprising a cationic compound disposed on at least one surface of a base paper, wherein 50% or more by weight of calcium carbonate is contained in terms of a solid content based on a total amount of the pigment contained in the ink-receiving layer; 75 to 90 parts by weight of the pigment, 1 to 10 parts by weight of the binder and 5 to 20 parts by weight of the inkjet ink-fixing agent are contained based on 100 parts by weight of the ink-receiving layer; the drop water absorbency of the ink-receiving layer (according to the drop water absorbency defined in Japan Technical Association of the Pulp and Paper Industry, J. TAPPI, No. 32-2:2000 except that a drop water amount is 0.001 ml) is 200 seconds or less; and a Stockigt sizing degree according to JIS-P-8122 for the inkjet recording medium is 5 seconds or less.

2. The inkjet recording medium according to claim 1, wherein a contact angle of the ink-receiving layer is 40 degrees or more after 0.06 seconds from dropping 0.004 ml of distilled water.

3. The inkjet recording medium according to claim 1, wherein a contact angle of the ink-receiving layer is less than 40 degrees after 0.06 seconds from dropping 0.004 ml of distilled water.

4. The inkjet recording medium according to claim 1, wherein the drop water absorbency of the ink-receiving layer is not greater than the drop water absorbency of a split plane (the drop water absorbency according to the drop water absorbency defined in Japan Technical Association of the Pulp and Paper Industry, J. TAPPI, No. 32-2:2000 except that a drop water amount is 0.001 ml) where the base paper is exposed when the inkjet recording medium is peeled off from the surface of the ink-receiving layer in the direction of the thickness.

5. The inkjet recording medium according to claim 1, wherein a basis weight of the inkjet recording medium is 30.0 $g/m^2$ to 70.0 $g/m^2$.

6. The inkjet recording medium according to claim 1, wherein a volume 50% average particle diameter (D50) as measured by laser light scattering method of the calcium carbonate contained in the ink-receiving layer is 0.3 to 10.0 μm.

7. The inkjet recording medium according to claim 1, wherein a coating amount of the ink-receiving layer in terms of solid content of one surface is 1.0 $g/m^2$ to 15.0 $g/m^2$.

8. The inkjet recording medium according to claim 2, wherein the drop water absorbency of the ink-receiving layer is not greater than the drop water absorbency of a split plane (the drop water absorbency according to the drop water absorbency defined in Japan Technical Association of the Pulp and Paper Industry, J. TAPPI, No. 32-2:2000 except that a drop water amount is 0.001 ml) where the base paper is exposed when the inkjet recording medium is peeled off from the surface of the ink-receiving layer in the direction of the thickness.

9. The inkjet recording medium according to claim 2, wherein a basis weight of the inkjet recording medium is 30.0 $g/m^2$ to 70.0 $g/m^2$.

10. The inkjet recording medium according to claim 2, wherein a volume 50% average particle diameter (D50) as measured by laser light scattering method of the calcium carbonate contained in the ink-receiving layer is 0.3 to 10.0 μm.

11. The inkjet recording medium according to claim 2, wherein a coating amount of the ink-receiving layer in terms of solid content of one surface is 1.0 $g/m^2$ to 15.0 $g/m^2$.

12. The inkjet recording medium according to claim 3, wherein the drop water absorbency of the ink-receiving layer is not greater than the drop water absorbency of a split plane (the drop water absorbency according to the drop water absorbency defined in Japan Technical Association of the Pulp and Paper Industry, J. TAPPI, No. 32-2:2000 except that a drop water amount is 0.001 ml) where the base paper is exposed when the inkjet recording medium is peeled off from the surface of the ink-receiving layer in the direction of the thickness.

13. The inkjet recording medium according to claim 3, wherein a basis weight of the inkjet recording medium is 30.0 $g/m^2$ to 70.0 $g/m^2$.

14. The inkjet recording medium according to claim 3, wherein a volume 50% average particle diameter (D50) as measured by laser light scattering method of the calcium carbonate contained in the ink-receiving layer is 0.3 to 10.0 μm.

15. The inkjet recording medium according to claim 3, wherein a coating amount of the ink-receiving layer in terms of solid content of one surface is 1.0 $g/m^2$ to 15.0 $g/m^2$.

16. The inkjet recording medium according to claim 4, wherein a basis weight of the inkjet recording medium is 30.0 $g/m^2$ to 70.0 $g/m^2$.

17. The inkjet recording medium according to claim 4, wherein a volume 50% average particle diameter (D50) as measured by laser light scattering method of the calcium carbonate contained in the ink-receiving layer is 0.3 to 10.0 μm.

18. The inkjet recording medium according to claim 4, wherein a coating amount of the ink-receiving layer in terms of solid content of one surface is 1.0 $g/m^2$ to 15.0 $g/m^2$.

19. The inkjet recording medium according to claim 5, wherein a volume 50% average particle diameter (D50) as measured by laser light scattering method of the calcium carbonate contained in the ink-receiving layer is 0.3 to 10.0 μm.

20. The inkjet recording medium according to claim 5, wherein a coating amount of the ink-receiving layer in terms of solid content of one surface is 1.0 $g/m^2$ to 15.0 $g/m^2$.

21. The inkjet recording medium according to claim 6, wherein a coating amount of the ink-receiving layer in terms of solid content of one surface is 1.0 $g/m^2$ to 15.0 $g/m^2$.

* * * * *